US010371467B2

(12) United States Patent
Gage et al.

(10) Patent No.: US 10,371,467 B2
(45) Date of Patent: Aug. 6, 2019

(54) HEAT EXCHANGER WITH VARIABLE THICKNESS COATING

(71) Applicant: Hamilton Sundstrand Corporation, Windsor Locks, CT (US)

(72) Inventors: Marc E. Gage, Feeding Hills, MA (US); Jeffrey A. Scarcella, Tariffville, CT (US); Kurt L. Stephens, Enfield, CT (US); Matthew Patterson, East Syracuse, NY (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1426 days.

(21) Appl. No.: 13/857,245

(22) Filed: Apr. 5, 2013

(65) Prior Publication Data

US 2014/0151001 A1 Jun. 5, 2014

Related U.S. Application Data

(60) Provisional application No. 61/733,804, filed on Dec. 5, 2012.

(51) Int. Cl.

| | |
|---|---|
| ***F28F 19/02*** | (2006.01) |
| *F28D 9/00* | (2006.01) |
| *F28D 21/00* | (2006.01) |

(52) U.S. Cl.

CPC ..... *F28F 19/02* (2013.01); *F28D 9/00* (2013.01); *F28D 2021/0021* (2013.01)

(58) Field of Classification Search

CPC .. F28F 19/02; F28F 19/04; F28F 19/06; F28F 21/089

USPC ..... 165/133, 134.1

See application file for complete search history.

(56) References Cited

U.S. PATENT DOCUMENTS

| | | | | |
|---|---|---|---|---|
| 3,880,232 | A * | 4/1975 | Parker | 165/166 |
| 4,421,789 | A * | 12/1983 | Kaneko et al. | 427/204 |
| 7,357,126 | B2 | 4/2008 | Durand et al. | |
| 7,574,981 | B1 * | 8/2009 | Schulz | 122/512 |
| 7,628,199 | B2 * | 12/2009 | Rothenhofer et al. | 165/146 |
| 2001/0054500 | A1 | 12/2001 | Raybould et al. | |
| 2007/0137627 | A1 * | 6/2007 | Durand et al. | 123/568.12 |
| 2012/0211215 | A1 * | 8/2012 | Ishiguro et al. | 165/185 |
| 2013/0062041 | A1 | 3/2013 | Sakae et al. | |

FOREIGN PATENT DOCUMENTS

| | | | | |
|---|---|---|---|---|
| DE | 102007035221 | | 2/2008 | |
| EP | 2578983 | | 4/2013 | |
| GB | 1339942 | A * | 12/1973 | F24H 1/145 |
| GB | 2296560 | | 7/1996 | |
| JP | 02170998 | A * | 7/1990 | |
| JP | 04099894 | A * | 3/1992 | |

(Continued)

OTHER PUBLICATIONS

Sugano, JP2011179737TRANS (English Translation), Sep. 2011.*

(Continued)

*Primary Examiner* — Eric S Ruppert

(74) *Attorney, Agent, or Firm* — Carlson, Gaskey & Olds, P.C.

(57) ABSTRACT

A heat exchanger includes a heat exchanger wall that bounds a passage. A coating lines the heat exchanger wall. The coating has a thickness that varies according to location on the heat exchanger wall.

13 Claims, 3 Drawing Sheets

(56) References Cited

FOREIGN PATENT DOCUMENTS

| | | | |
|---|---|---|---|
| JP | 2011179737 | * | 9/2011 |
| WO | WO2008017382 | * | 2/2008 |

OTHER PUBLICATIONS

Schaper, WO2008017382TRANS (English Translation), Feb. 2008.*
Shimajiri, Yoshifumi, JP02170998ATRANS (English Translation), Jul. 1990.*
Kojima, Masahiro, JP04099894ATRANS (English Translation), Mar. 1992.*
Shimajiri , JP02170998AHT (English Translation), Jul. 1990.*
Kojima, JP04099894AHT (English Translation), Mar. 1992.*
European Search Report for Application No. 13192934.1, dated Sep. 14, 2014.

* cited by examiner

HEAT EXCHANGER WITH VARIABLE THICKNESS COATING

CROSS-REFERENCE TO RELATED APPLICATION

The present disclosure claims priority to U.S. Provisional Application 61/733,804 filed Dec. 5, 2012.

BACKGROUND

This application relates to corrosion protection of heat exchangers.

Heat exchangers are known and used in various types of thermal management systems. For example, thermal management systems in aircraft utilize air/liquid coolant heat exchangers to control the temperature of power electronics. Generally, such heat exchangers are subject to corrosive conditions because of exposure to air. For instance, corrosion can cause leaks in the heat exchanger and reduction in thermal management control. The heat exchanger therefore includes a corrosion-resistant coating.

SUMMARY

Disclosed is a heat exchanger that includes a heat exchanger wall that bounds a passage. A coating lines the heat exchanger wall. The coating has a thickness that varies according to location on the heat exchanger wall.

In another aspect, a heat exchanger includes an inlet face arranged to receive ram air, an exit face opposed from the inlet face and a plurality of heat exchanger walls extending between the inlet face and the exit face. The heat exchanger walls define a plurality of passages that open at respective leading edges at the inlet face and at respective trailing edges at the exit face. A coating lines the plurality of heat exchanger walls. The coating has a thickness that varies according to location on the plurality of heat exchanger walls.

Also disclosed is a method of protecting a heat exchanger from corrosion. The method includes providing a heat exchanger wall that bounds a passage and identifying at least one location on the heat exchanger wall that is more susceptible to corrosion than at least one other location on the heat exchanger wall. A coating is provided on the heat exchanger wall in a thickness that varies according to the identified locations such that the coating has a first thickness T1 at the location on the heat exchanger wall that is more susceptible to corrosion and a second, different thickness T2 at the least one other location on the heat exchanger wall, where T1 is greater than T2.

DETAILED DESCRIPTION

Figure 1:
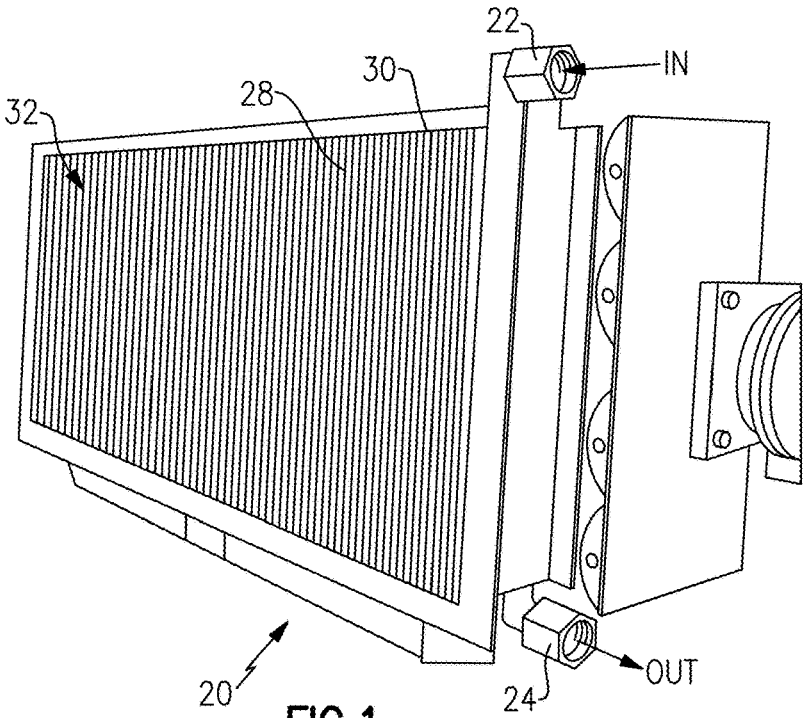
FIGS. 1 and 2 illustrate different perspective views of an example heat exchanger.
Figure 2:
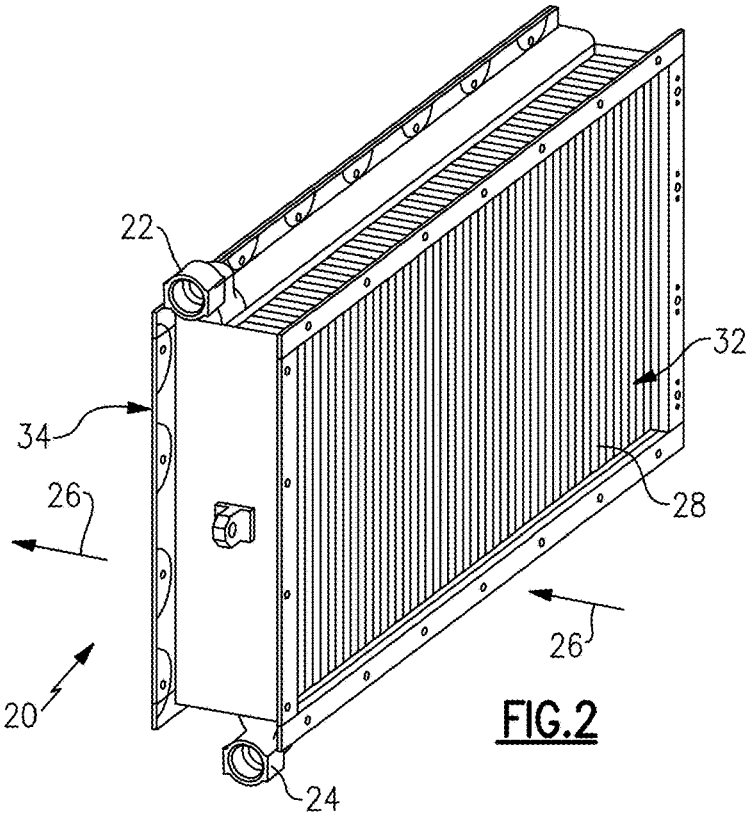

FIGS. 1 and 2 show perspective views from different angles of an example heat exchanger 20. In this example, the heat exchanger 20 is an air/liquid heat exchanger that includes an inlet 22 and an outlet 24 for conveying liquid coolant through the heat exchanger 20. Air 26, such as ram air in an aircraft end-use, can be conveyed through the heat exchanger 20 to remove heat from the liquid coolant.

In this example, the heat exchanger 20 is a plate and fin arrangement that includes a plurality of plates 28 that define internal channels (not shown) for the conveyance of the liquid coolant. The plates 28 are separated from one another by a plurality of fins 30, which facilitate thermal transfer between the air 26 and the liquid coolant through the walls of the plates 28. The plates 28 and fins 30 are formed of a metallic material, as described in further detail below. It is to be understood that the examples herein are not limited to plate and fin arrangements.

The air 26 conveyed through the heat exchanger 20 can carry moisture or other substances that can contribute to corroding the metallic material of the heat exchanger 20. In this regard, as the air 26 encounters the heat exchanger 20, the moisture or other substances can deposit on the heat exchanger 20, causing potentially corrosive conditions at that location. The moisture or other substances tend to deposit or accumulate in the locations at which the air 26 first encounters the heat exchanger 20.

For example, referring to FIG. 2, the air 26 enters the heat exchanger 20 from the right-hand side and travels through the heat exchanger 20 exiting at the left-hand side. Thus, the heat exchanger 20 includes a ram face 32 where the air 26 enters the heat exchanger 20 and an exit face 34 (FIG. 4) where the air 26 exits the heat exchanger 20.

Figure 3:
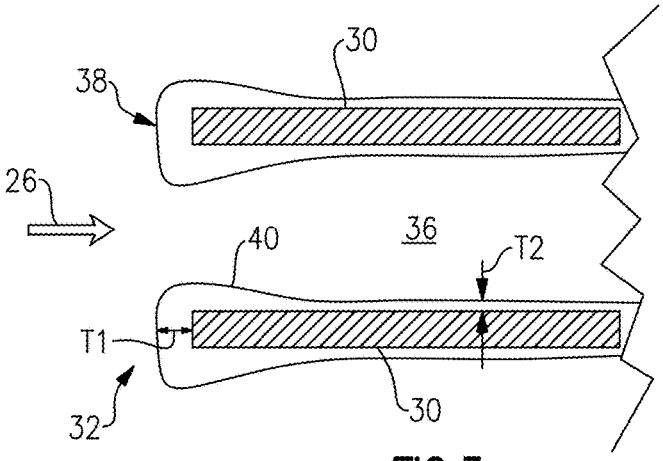
FIG. 3 shows a cross-section through a portion of the heat exchanger of FIGS. 1 and 2 at a ram face.
Figure 4:
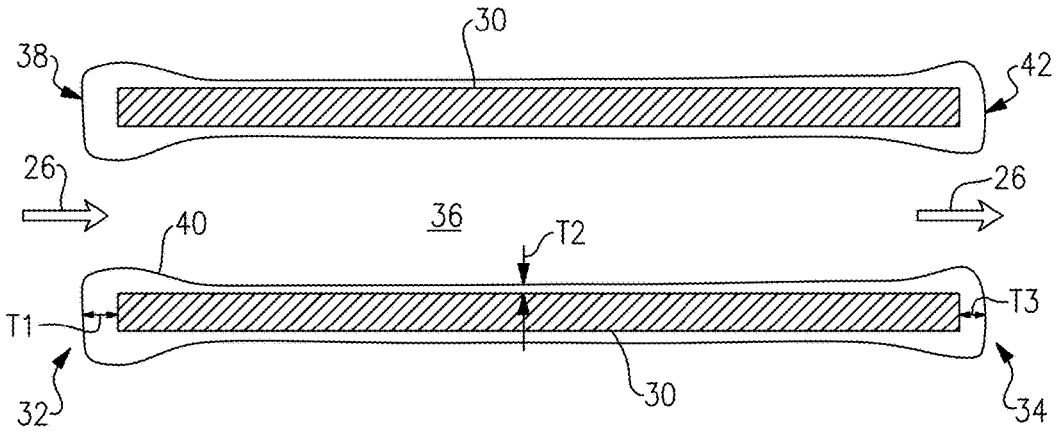
FIG. 4 shows a cross-section through a passage of the heat exchanger of FIGS. 1 and 2.

FIG. 3 shows a portion of the ram face 32 and two of the fins 30 at the ram face 32. The heat exchanger 20 includes passages 36 between adjacent ones of the fins 30 through which the air 26 travels between the ram face 32 and the exit face 34 (FIG. 4). The passages 36 are bounded by the plates 28 and the fins 30. Thus, the plates 28 and the fins 30 are walls that define and bound the passages 36.

The passages 36 include an initial or inlet section 38 at the ram face 32 that first encounters the incoming air 26. It is at this location that the heat exchanger 20 can be most susceptible to the deposition and accumulation of moisture or other substances than can contribute to corrosion. In this regard, the heat exchanger 20 includes a corrosion-resistant coating 40 that lines, by fully or substantially covering, the fins 30. The coating 40 can also cover the plates 28 and thus the examples herein are also applicable to the plates 28.

As shown, the coating 40 has a variable thickness with a first thickness T1 and a second, different thickness T2. In this example, T1 is greater than T2. As also shown, the location of T1 is at the leading edge of the fins 30 in the inlet section 38 of the ram face 32 and the location of T2 is at the interior of the passage 36, spaced inwards from the leading edge. As an example, T2 can be in the middle third of the passage 36. The thickness of the coating 40 can gradually change between the locations at T1 and T2. In this example, the inlet section 38 is encapsulated in a relatively thicker part of the coating 40 and the thickness then gradually decreases into the passage 36.

At the ram face 32 where the moisture or other substances can primarily deposit or accumulate, the coating 40 is thus thicker to provide a greater degree of corrosion protection. At the location of T2 inside of the passage 36, the coating 40 is thinner because less moisture or other substances deposit and less corrosion protection is therefore needed. Such locations where relatively greater and lesser corrosion protection is needed can be identified experimentally via observations from corrosion testing of heat exchangers, corrosion testing of test pieces and/or testing simulations, for example.

In a further example, the thickness of the coating 40 can be represented by a maximum thickness and a minimum thickness. In one example, the maximum thickness is T1 and the minimum (non-zero) thickness is T2. For example, a ratio of T1/T2 is equal to or greater than 2. In a further example, the ratio of T1/T2 is 3-7. In a further example, the ratio of T1/T2 is 10 or greater. In a further example, the thickness T1 is not less than 25.4 micrometers (i.e., the thickness T1 is greater than or equal to 25.4 micrometers). In a further example, the thickness T2 is no less than 2.54 micrometers (i.e., the thickness T2 is greater than or equal to 2.54 micrometers).

While FIG. 3 only shows the leading edge of the fins 30 in the inlet section 38 at the ram face 32, FIG. 4 also shows the exit face 34. In this example, the fins 30 include a trailing edge at an outlet portion 42, at which the coating 40 has a thickness T3. For example, T3 is equal to or approximately equal to T1 and is thicker than T2 by any of the above-described ratios. As can be appreciated however, in other examples, the thickness T3 may be equal to or approximately equal to T2 such that the coating 40 is nominally thicker only at the location of T1 at the inlet section 38.

The coating 40 can be an organic coating and the plates 28 and fins 30 of the heat exchanger 20 can be a metallic material. In one example, the coating 40 is an epoxy-based organic coating and can be deposited onto the heat exchanger 20 using an electrodeposition technique. In such a technique, the voltage and time used to deposit the coating 40 can be controlled to accentuate or change the variable thickness of the coating 40. The metallic material of the fins 30 can be aluminum or aluminum alloy. Likewise, the plates 28 can also be aluminum or aluminum alloy and may be brazed or otherwise bonded to the fins 30 in a known manner.

By providing the coating 40 with a thicker portion at the location of thickness T1 and a thinner portion at the location of thickness T2, good corrosion protection is locally provided while reducing weight of the heat exchanger 20. For example, a heat exchanger that has a relatively uniform thickness coating approximately equivalent to the thickness T1 has a greater weight than the heat exchanger 20 that uses locally thick portions of the coating 40 only where needed.

Figure 5:
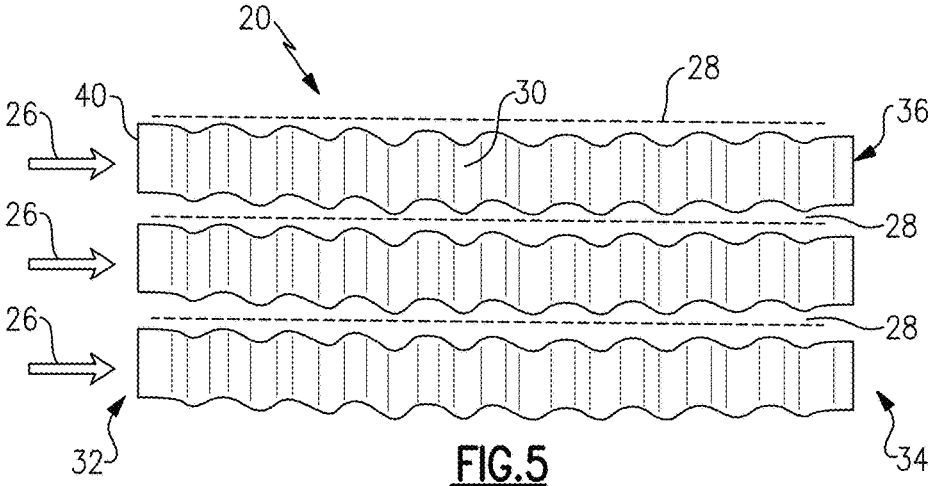
FIG. 5 shows a sectioned view of the heat exchanger 20 with plates and fins.
Figure 6:
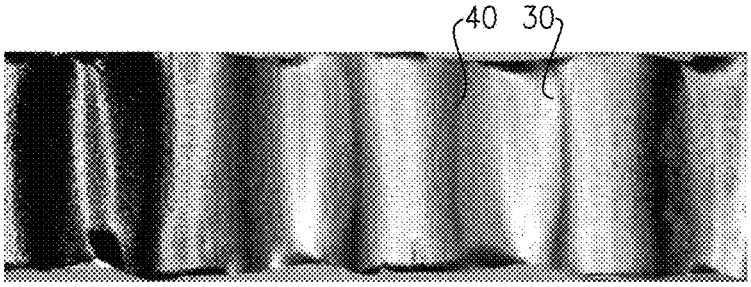
FIGS. 6, 7 and 8 show corrosion testing results.
Figure 7:
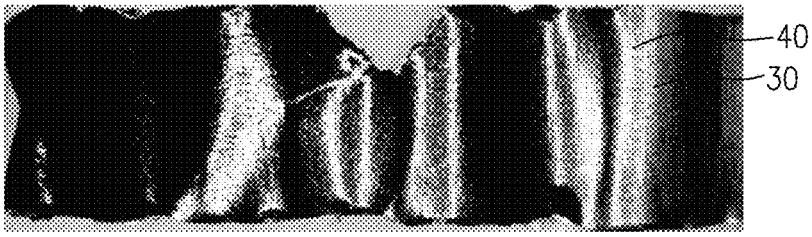
Figure 8:
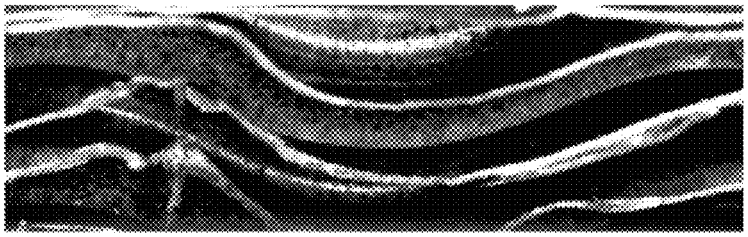

FIG. 5 shows a sectioned view of the heat exchanger 20 with the fins 30. FIGS. 6, 7, and 8 show corrosion testing conducted under ASTM B117 salt spray for 2,016 hours. In FIG. 6 a portion of one of the fins 30 tested is shown. The fin 30 shows no corrosion with the coating 40 at the thinner thickness T2. FIG. 7 shows a comparative fin 30 with the coating 40 at the thicker thickness of T1 and also shows no corrosion. FIG. 8 shows a brazed intersection of the fins 30 and plates 28 with no corrosion.

Aircraft air management systems are required to operate in corrosive environments. The corrosive environments can cause corrosion damage to heat exchangers and other components within the aircraft air management system. The corrosion damage can lead to leaks within the air management system. In a liquid cooled air management system, leakage of the liquid coolant can cause a malfunction of the liquid cooling system. Malfunction of the liquid cooling system can cause aircraft downtime due to unscheduled maintenance activity. An electrodeposited organic coating has been demonstrated to provide superior corrosion protection. However, existing coating processes can result in a weight increase of approximately 2 to 3 pounds.

Corrosion damage can occur as a result of the corrosive environment present in aircraft air management systems. Liquid coolant leakage can result from corrosion damage to liquid to air heat exchangers. In order to address the corrosion issue, an electrodeposited organic coating has been applied to the heat exchanger. This electrodeposited organic coating has been demonstrated to provide a level of corrosion protection superior to the corrosion protection offered by the previously used silicone aluminum coating. However, the process used to apply the electrodeposited organic coating results in a very thorough coating resulting in a weight increase of approximately 2 to 3 pounds. In the examples herein, reduced thickness of the coating 40 results in a heat exchanger with variable coating thickness. The reduced coating thickness results in an estimated weight reduction of 1.5 pounds per heat exchanger compared with a uniform coating. Coating thickness is reduced at the core of the heat exchanger, but thickness is greater at the heat exchanger core face where corrosion is likely to occur. A section of heat exchanger coated with the variable thickness coating has been demonstrated to exhibit no corrosion when subjected to salt spray testing for 2000 hours. Therefore, the variable thickness coating will provide excellent corrosion resistance while reducing the weight of aircraft heat exchangers. Furthermore, the process associated with the thinner coating results in reduced processing time and reduced coating material consumption.

There are a number of benefits associated with the examples disclosed herein. By coating the heat exchanger 20 with a variable thickness coating, the maximum corrosion resistance is provided at the heat exchanger core face where corrosion is likely to occur. The coating thickness is reduced in the interior of the heat exchanger core where corrosion is less likely to occur. The reduced thickness in the interior of the heat exchanger core results in an estimated weight reduction of 1.5 pounds per heat exchanger compared with the current process. The thinner coating in the heat exchanger core is expected to result in improved heat transfer and reduced pressure drop. The process associated with the thinner coating results in reduced processing time in a coating bath. The thinner coating also results in reduced coating material consumption. Reduced processing time and reduced coating material consumption are expected to result in lower costs.

An electrodeposition coating process can be used to coat heat exchangers with a greater thickness at the inlet and exit and lesser thickness thinner on the inside. Thicker coating can be beneficial at the inlet, since corrosion typically occurs at the ram face. Weight reduction can be achieved. Testing conducted on the alloys actually used to construct a heat exchanger has shown that this variable thickness coating approach provides excellent corrosion protection.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

The invention claimed is:

1. A heat exchanger comprising:

a first plate;

a second plate;

a heat exchanger wall bounding a passage, wherein the wall is a fin separating the first plate and the second plate; and a coating lining the heat exchanger wall, the coating having a thickness that varies according to location on the heat exchanger wall, wherein the heat exchanger wall has an edge and a location spaced from the edge, the coating is thicker at the edge than at the location spaced from the edge, wherein the coating has a maximum thickness of T1 and a minimum thickness of T2 such that a ratio of T1/T2 (T1 divided by T2) is equal to or greater than 2, and the edge is a leading edge with respect to the passage being arranged to receive a flow of a fluid.

2. The heat exchanger as recited in claim 1, wherein the coating is organic.

3. The heat exchanger as recited in claim 1, wherein the coating is an epoxy-based coating.

4. The heat exchanger as recited in claim 1, wherein the heat exchanger wall has a second edge opposite the edge, the location is spaced from the second edge, the coating is thicker at the second edge than at the location, and the second edge is a trailing edge with respect to the passage being arranged to receive a flow of a fluid.

5. The heat exchanger as recited in claim 1, wherein the coating has a maximum thickness at the leading edge.

6. The heat exchanger as recited in claim 1, wherein the coating has a gradual transition between a maximum thickness location and a minimum thickness location.

7. The heat exchanger as recited in claim 1, wherein the ratio is from 3 to 7.

8. The heat exchanger as recited in claim 1, wherein the ratio is 10 or greater.

9. The heat exchanger as recited in claim 1, wherein the maximum thickness T1 is greater than or equal to 25.4 micrometers.

10. The heat exchanger as recited in claim 9, wherein the maximum thickness T2 is greater than or equal to 2.54 micrometers.

11. The heat exchanger as recited in claim 1, comprising an inlet face; and an exit face, wherein the inlet face comprises the leading edge.

12. A heat exchanger comprising:

a first plate;

a second plate;

an inlet face arranged to receive ram air;

an exit face opposed from the inlet face;

a plurality of heat exchanger walls extending between the inlet face and the exit face, the plurality of heat exchanger walls defining a plurality of passages that open at respective leading edges at the inlet face and at respective trailing edges at the exit face, wherein the plurality of heat exchanger walls are fins separating the first plate and the second plate; and a coating lining the plurality of heat exchanger walls, the coating having a thickness that varies according to location on the plurality of heat exchanger walls, wherein the coating has a maximum thickness at the leading edges, wherein the coating has a maximum thickness of T1 and a minimum thickness of T2 such that a ratio of T1/T2 (T1 divided by T2) is equal to or greater than 2.

13. The heat exchanger as recited in claim 12, wherein the plurality of heat exchanger walls are metallic and the coating is organic.

* * * * *